United States Patent [19]

Hering, Sr.

[11] Patent Number: 4,775,287

[45] Date of Patent: Oct. 4, 1988

[54] ADJUSTABLE BOOM

[76] Inventor: James R. Hering, Sr., 1101 E. 161st Pl., South Holland, Ill.

[21] Appl. No.: 51,861

[22] Filed: May 18, 1987

[51] Int. Cl.[4] ..... E02F 3/00

[52] U.S. Cl. ..... 414/694; 414/718

[58] Field of Search ..... 414/687, 694, 718, 728; 172/311, 456

[56] References Cited

U.S. PATENT DOCUMENTS

| | | | |
|---|---|---|---|
| 3,388,819 | 6/1968 | Przybylski | 414/694 |
| 3,977,547 | 8/1976 | Holopainen | 414/687 |
| 4,327,932 | 5/1982 | Anderson | 172/311 X |

OTHER PUBLICATIONS

"Gradall Hydraulic Excavators Catalog No. G660C", 1985, The Gradall Company, New Philadelphia, Oh. 44663.

"See How To Beat Competitive Bidding with Gradall Attachments", Form No. EE-18412-R-5/85, The Gradall Company, New Philadelphia, Oh. 44663.

*Primary Examiner*—Robert J. Spar
*Assistant Examiner*—Donald W. Underwood
*Attorney, Agent, or Firm*—Alan B. Samlan; Basil E. Demeur

[57] ABSTRACT

An earth moving or grading machine having a first boom mounted on the base structure. A second boom is telescopically mounted to be received by the first boom and a third boom is mounted to the outermost end of the second boom. Articulated connecting means connects the third boom to the second boom so that the angle of articulation between the telescopically mounted second boom and the third boom can be adjusted.

3 Claims, 2 Drawing Sheets

FIG. 6
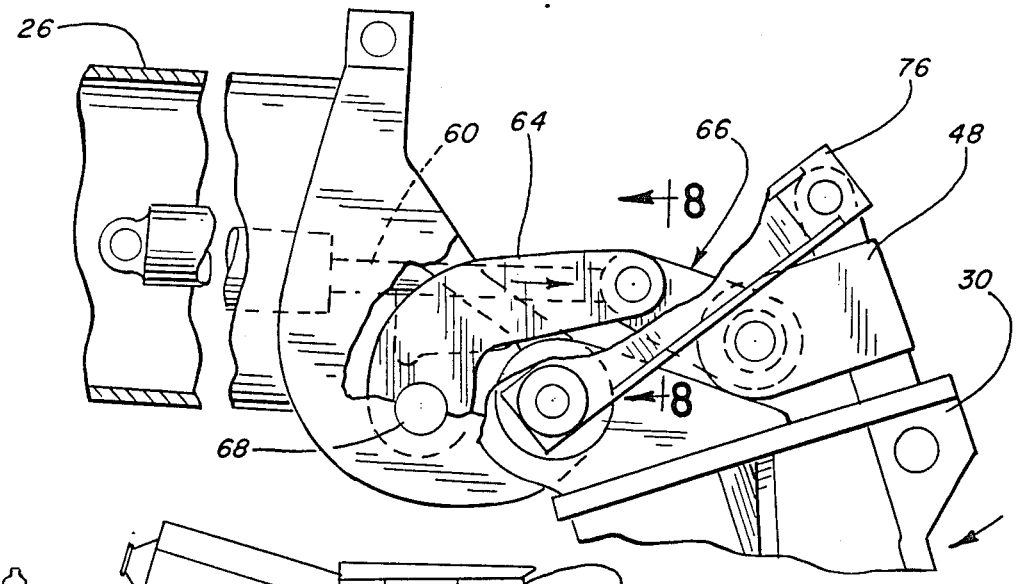
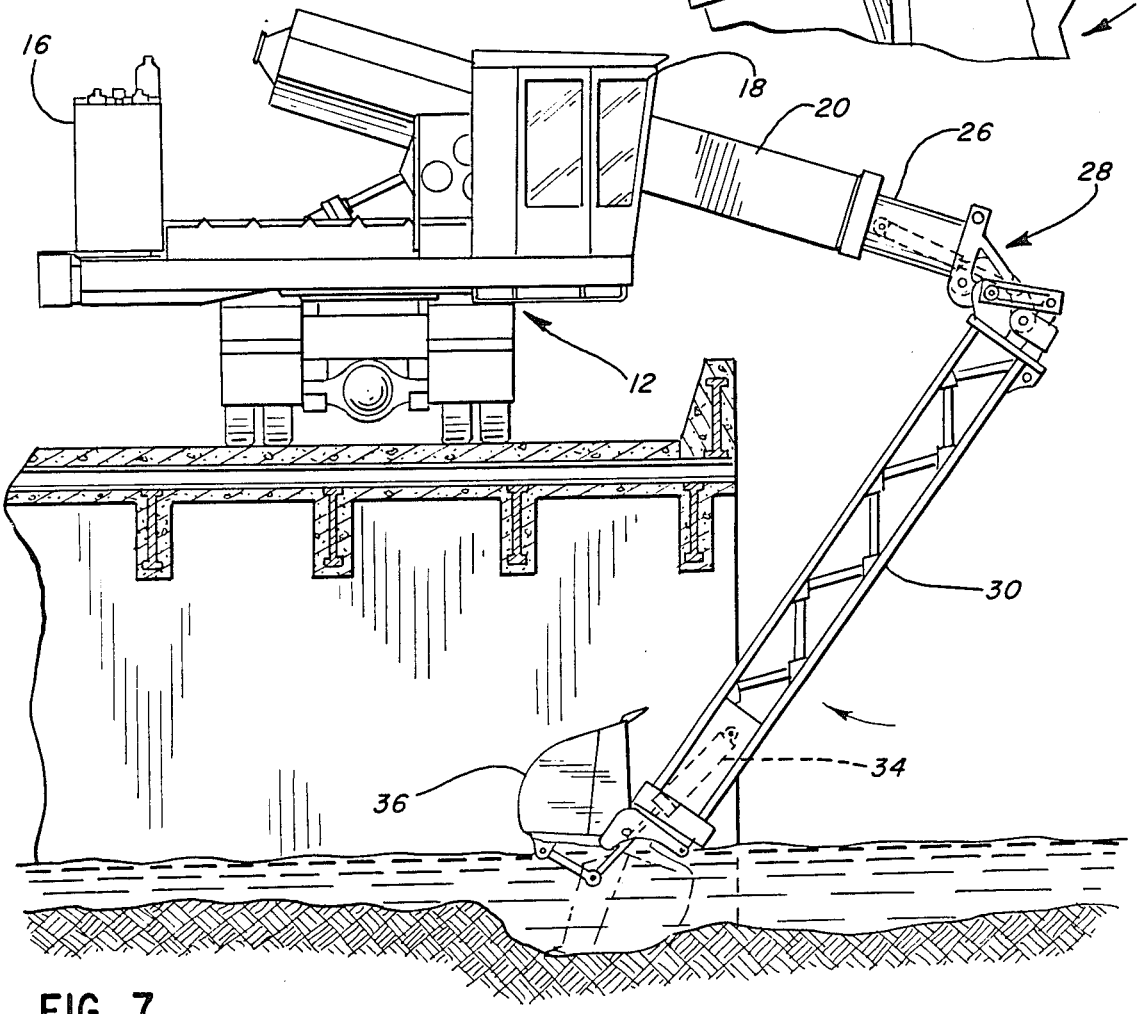
FIG. 7
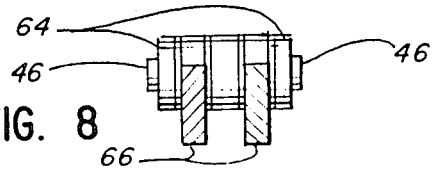
FIG. 8

ADJUSTABLE BOOM

BACKGROUND AND SUMMARY OF THE INVENTION

This invention relates to earth moving equipment and more particularly to excavating equipment utilizing a telescopically extendable boom with a digging bucket at the outermost end.

In the past there has been provided a piece of machinery for grading, excavating or other earth moving that has a boom capable of being extended and retracted. The boom can also be rotated as it is extended or retracted. The extending boom has attached to it a bucket at its outermost end which is used to excavate or otherwise move material. This equipment has been marketed under the name "Gradall" hydraulic excavators and is manufactured by The Gradall Company. The earth moving equipment is provided with hydraulic means connected to a mechanical linkage extending through the boom which is connected to and used to control the movement of the bucket. The hydraulic means to operate the linkage is located towards the base or cab end of the boom.

When using this type of equipment it was difficult, if not impossible, to unload materials from containers such as freight cars or trucks due to the angle of the bucket with respect to the boom and the container walls. In its normal configuration the boom could not be extended down into the container because of the limited pivotal movement of the boom and its inability to reach over and down into the container. The equipment was also limited in excavating applications whenever the excavation required removal of materials directly below the main body of the equipment as the boom could not be extended back under itself.

One solution was to provide an attachment onto the extendable boom which was at approximately 90° with respect to the extendable boom. The existing mechanical linkage used to control the bucket was connected to additional mechanical linkage running through the 90° attachment so that the operator could still control the bucket as it was lowered into the container or wherever the material was to be moved.

However, a problem with this arrangement was that the 90° attachment that was added was set at one predetermined angle and could not be varied. Furthermore, there was provided additional solid mechanical linkage to control the bucket through the 90° attachment. Due to this solid linkage arrangement, the boom extension could only be set at one pre-determined angle which could not be varied. Another shortcoming of this arrangement was the additional weight of the linkage being added to the boom structure. Still another disadvantage was the limited added flexibility of the 90°0 boom attachment. It could only be used in special applications such as extending over a freight car or truck container wall wherein a 90° boom attachment may be acceptable. However, it could not be used in other applications where it may be desirable to have the attachment at only a small angle with respect to the main boom. Likewise, it would not function where it is necessary to have the boom and bucket extend back underneath the extendable boom for excavating in areas such as underneath bridges or viaducts while the piece of excavating machinery was positioned directly above the area to be excavated.

Another type of earth moving equipment is illustrated in U.S. Pat. No. 2,840,254 entitled "Clamshell Earth-Moving Machine." This patent shows a machine with a telescopic boom section having a hoe stick positioned at the outermost end of the boom. The hoe stick is pivotally mounted at approximately its center location and the upper end of the hoe stick is connected to a fluid actuated cylinder. The opposite end of the hoe stick has a clamshell bucket. There are at least two apparent shortcomings in this device. The first is the large size of the cylinder and piston required to pivot the hoe stick due to the design and mounting configuration. The second is that there is no means to provide for the hoe stick to be set and fixed at a predetermined angle. As the boom extends, and the cylinder and piston are held constant, the angle of the hoe stick with respect to the boom will change. This is an undesirable result as it requires the operator to go through several maneuvers to maintain the predetermined angle while extending the boom.

Other prior devices such as illustrated in U.S. Pat. Nos. 4,353,424; 3,445,015; 4,497,608; and 3,517,960 are not applicable to this invention as they do not address the problems of an earth moving machine having an extendable boom. Likewise, they do not provide for a pivotal joint on the end of an extendable telescopic boom such that a boom extension can be mounted at an angle with respect to the end of the extendable boom.

Applicant has solved the problems of the prior art by providing an earth moving machine having a first boom mounted on the base structure or platform of the machine. The first boom can be swiveled and pivoted on the base structure. There is a second boom telescopically received within the first boom. A third or extending boom is mounted to the outermost end of the second boom. In a first embodiment an adjustable joint connects one end of the third boom to the outermost end of the second boom at a pre-determined, fixed angle. By the use of additional linking members, the angle between the third and second booms can be adjusted. With this articulated connection, the third boom or boom extension can reach areas that were previously inaccessible by a conventional earth moving machine having a telescopic boom mounted relative to the first platform mounted boom. The bucket mounted at the end of the third or extension boom can reach areas directly underneath the earth moving machine in applications such as dredging streams beneath a bridge while the earth moving machine is parked directly above the area to be dredged. In order to provide the adjustable connecting joint, the hydraulic cylinder used to control the bucket movement is repositioned on the third or extending boom and connected to the power source by means of flexible hydraulic hoses. This eliminates the necessity of a solid linkage connecting the hydraulic cylinder to the bucket along the entire length of the booms.

In another embodiment the third boom or boom extension has one end connected to the outermost end of the telescopic boom by means of an adjustable joint having a hydraulic cylinder and piston mounted within the extending telescopically mounted boom. The adjustable ram or piston is connected to the third boom such that as the adjustable ram extends, the angle of the third boom relative to the extending boom can be dynamically adjusted.

Thus, it is an object of the present invention to provide an earth moving machine capable of having a first platform mounted boom which receives therein a telescopically mounted boom, and a third boom operably connected to the telescopically mounted boom such that one end of the third boom is mounted to the second boom by articulated connecting means so that the angle of the third boom with respect to the second boom can be varied.

Another object is to provide a third boom which is connected to the second extendable boom by means of an adjustable joint that can vary the angle between the second and third booms.

Related to this object is the object of providing a boom extension that can be connected at an acute angle with respect to the boom extension to allow the bucket to excavate in areas directly underneath the earth moving machine such as underneath a viaduct or bridge.

Yet another object is to provide a boom extension that can have the angle of the boom extension with respect to the extendable boom continuously varied by means of a hydraulic cylinder which controls the angle of the two booms with respect to each other.

These and other objects and advantages will become apparent upon reading the description of the preferred embodiments and the brief description of the drawings.

BRIEF DESCRIPTION OF THE DRAWINGS

FIG. 6 is an enlarged side fragmentary view similar to FIG. 4 with the hydraulic cylinder extended to change the angle of the boom extension.

FIG. 7 is an end view of the earth moving machine and boom configuration when excavating directly beneath the machine showing the bucket in two positions.

FIG. 8 is a cross-sectional view taken along line 8—8 of FIG. 6 showing the connection between the hydraulic ram and several force transmitting links.

DESCRIPTION OF THE PREFERRED EMBODIMENTS

Figure 1:
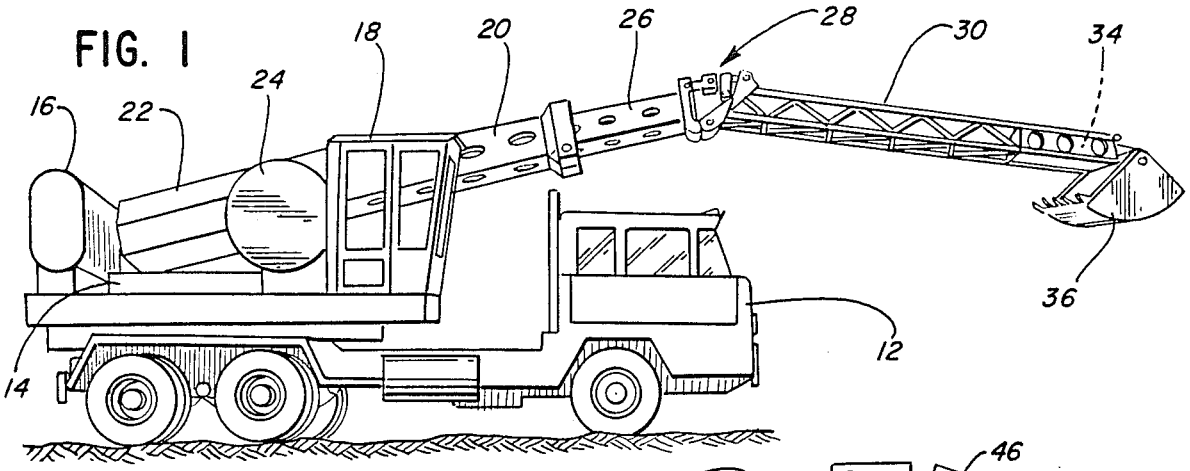
FIG. 1 is a side elevation view of the inventive adjustable joint connecting the telescopic boom to the boom extension on an earth moving machine.

Turning first to FIG. 1, there is illustrated an earth moving or grading machine 10 which is mounted on a truck 12. The bed of the truck 12 is provided with a turntable base 14 that rotates over the truck's rear wheels. A motor 16 provides power to the turntable base 14 so that the base 14 can rotate. The machine 10 has a cab 18 in which the operator is housed for controlling the earth moving machine. The cab 18 is mounted on the turntable base 14 so that it moves with the turntable as the grading or earth moving is accomplished.

Also mounted on the turntable 14 is a boom 20 generally of a trihedral form. A counterweight 22 is provided at the lower end of the boom 20 to give structural stability to the machine 10 during excavating or grading. The boom is allowed to pivot about a pivot mounting 24 such that the end of the boom opposite the lowermost end is allowed to pivot up or down within a predetermined range. The boom 20 is hollow and is provided with internal rollers so that it can telescopically receive a telescopic boom 26 which is of a similar trihedral shape but is smaller so that it can engage the rollers within the boom 20 and is capable of telescoping therein. There are power means provided (not illustrated) so that the operator can control the extension and retraction of the telescopic boom 26.

The outer end of the telescopic boom 26 is provided with an adjustable joint 28 which connects the telescopic boom 26 to a boom extension 30. The boom extension 30 can be of several designs such as a steel tubular frame construction as illustrated with a separate add on portion such as the trihedral extension 32. Alternatively, the boom extension can be constructed of only one or the other design.

Located at the outermost end of the boom extension 30 or 32 is a hydraulic cylinder 34 which is operably connected by a linkage to a bucket 36. The hydraulic cylinder 34 is fluidly connected by means of hydraulic hoses (not illustrated) to the hydraulic power source. The operator can thus control the movement of the bucket 36 by means of the hydraulic cylinder 34.

Figure 2:
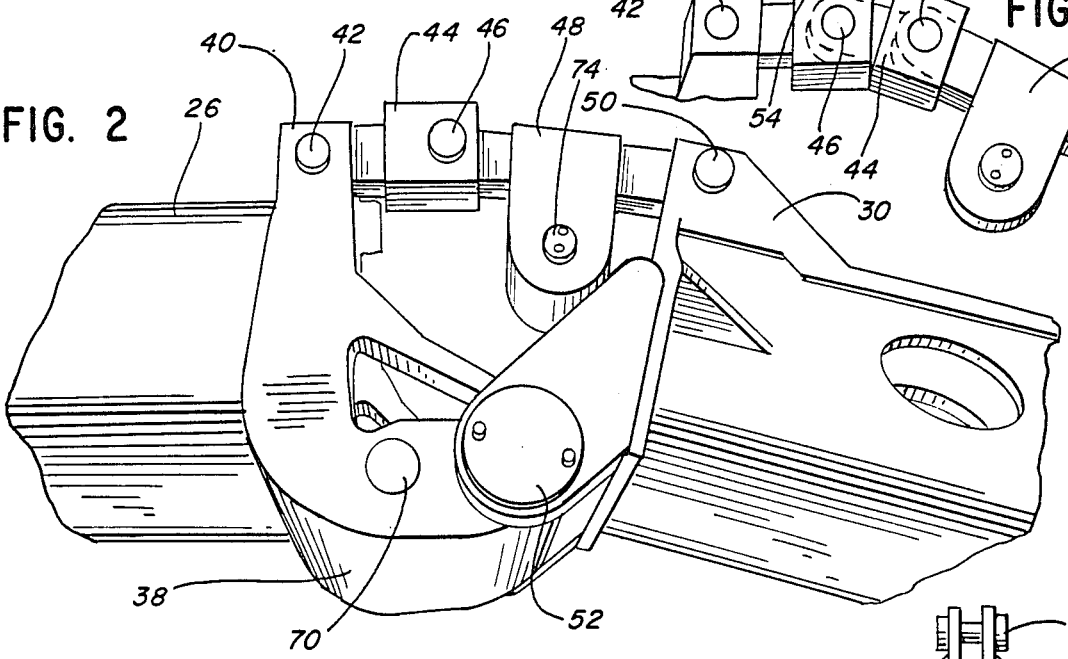
FIG. 2 is an enlarged view with portions removed of the inventive adjustable joint having two fixed links to set the angle of the boom extension with respect to the telescopic boom.
Figure 3:
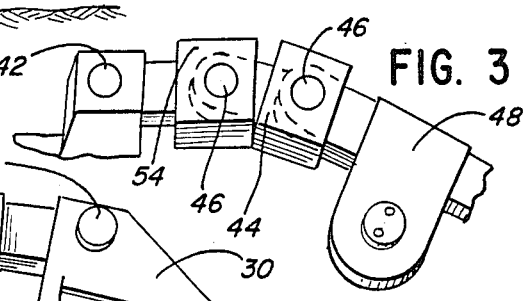
FIG. 3 is an alternate embodiment with portions removed of the adjustable joint of FIG. 2 in which three links are used to set the angle of the adjustable boom with respect to the telescopic boom.
Figure 5:
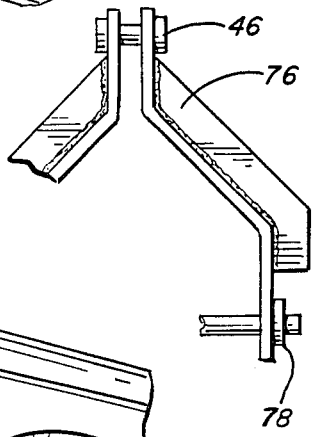
FIG. 5 is a front view with portions removed of the yoke used to connect the boom extension to the telescopic boom when using the embodiment shown in FIG. 4 to vary the angle of the two booms with respect to each other.

Turning to FIG. 2, the adjustable joint 28 is clearly illustrated. There is a J member 38 formed as a casting connected to the outermost end of the telescopic boom 26. At the top end 40 of the J member there is a pin 42 connected to one end of a first link 44. A second pin 46 connects the other end of the first link 44 to one end of a second link 48. The second link 48 is then connected by means of a pin 50 to the boom extension 30. The lower end of the J member 38 is connected by means of a pivot rod 52 which passes through the J member 38 and complementary aligned receiving holes at one end of the boom extension 30. As can be readily seen, the angle between boom 26 and boom extension 30 is determined by the length of the linkage between pins 42 and 50. For example, as seen in FIG. 3, the addition of a third link 54 between pin 42 and first link 44, increases the overall length of the linkage between pins 42 and 50. Thus the boom extension 30 will be pushed down to assume a smaller angle with respect to boom 26. As the links 44 or 48 are lengthened, or additional links are added, the boom extension 30 can assume an angle of 90° or even an acute angle with respect to boom 26. The angle that the boom extension 30 forms with respect to boom 26 can be adjusted as previously described, and once the angle is determined, the angle will remain fixed at the predetermined amount in this static linkage arrangement.

Figure 4:
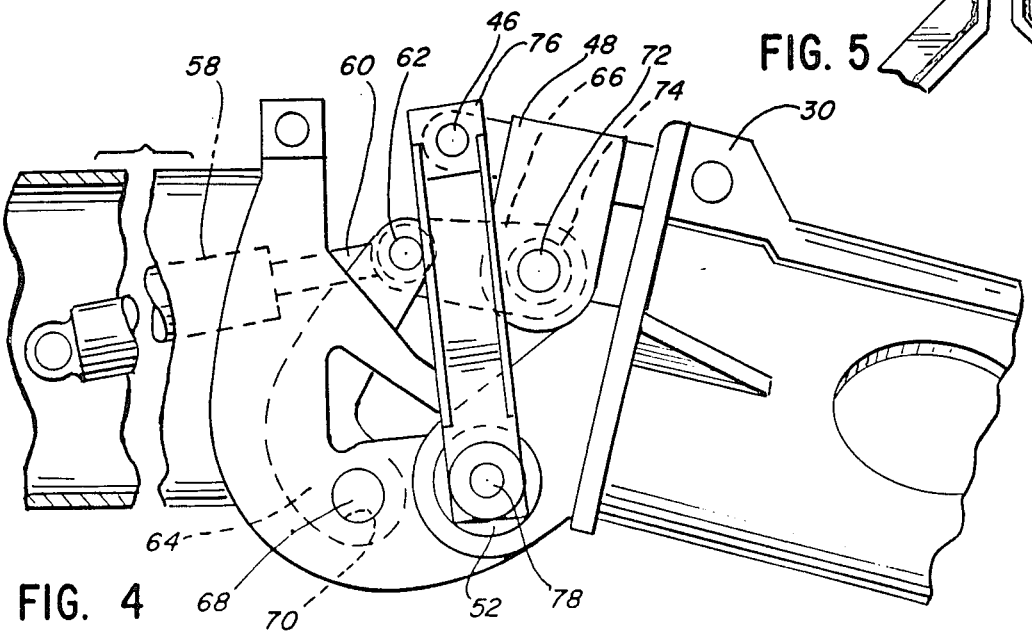
FIG. 4 is an enlarged side fragmentary view with portions removed of an alternate embodiment in which a hydraulic cylinder is used to adjust the angle of the boom extension with respect to the telescopic boom.

FIG. 4 shows an alternate embodiment in which the angle of articulation between boom 26 and boom 30 can be adjusted during the excavating or grading operation. Particularly, a hydraulic cylinder 56 is added to the outermost end of the telescopic boom 26. There is a cylinder 58 with an internal piston controlled by hydraulic pressure. An adjustable ram 60 is connected to the piston. The outer end of the ram 60 is connected at a common pivotal connection 62 to one end of a dog leg link 64 and connecting line 66. The opposite end of the dog leg link 64 is connected by a pivot pin 68 passing through receiving hole 70 in the J member 38. The opposite end of the connecting link 66 is connected by a pivot pin 72 passing through receiving hole 74 at the bottom of the second link 48.

A yoke 76 has its top end connected to the second link 48 by means of the second pin 46 and its bottom end connected to the pivot rod 52 by means of a pin 78 or other type of fastener. The yoke 76 adds additional structural strength to the adjustable joint 28 in this dynamic configuration. As the hydraulic cylinder 56 is operated, the position of the adjustable ram 60 is controlled. As illustrated in FIG. 6, when the ram 60 extends, the dog leg link 64 and connecting link 66 force the boom extension 30 downward causing the end of the boom extension with the bucket 36 to be lowered. As the adjustable ram 60 is retracted, the pivotal linkage will cause the outermost end of the boom extension 30 to be raised. Thus, the angle of articulation between the boom 26 and boom extension 30 can be varied within the range of the adjustable ram 60 during the grading or excavating operation.

Thus it can be seen that with the ability of the boom extension 30 to articulate at extreme angles with respect to the telescopic boom 26, the capabilities of the machine 10 are greatly enhanced. For example, as seen in FIG. 7 the earth moving machine 10 can be positioned on a bridge and the telescopic boom extended. By having the boom extension 30 placed at an acute angle by means of the adjustable joint 28 with respect to the telescopic boom 26, the bucket can be positioned underneath the truck so that excavating can be accomplished in a manner that was heretofore not possible with this type of equipment. Likewise, the adjustable joint can allow the boom extension 30 to be at an angle allowing the bucket 36 to remove material from a truck or other similar container.

The positioning of the hydraulic cylinder 34 adjacent the outermost end of the boom extension 30 (or boom extension 32) is necessary to permit adjustment of joint 28. Only hydraulic hoses must be extended through the boom extension 30 and telescopic boom 26 to the hydraulic source. If the hydraulic cylinder was placed in its normal position, which is within the telescopic boom 26, a solid linkage must be placed internal to the boom extension 30 in order to control the bucket 36. This solid mechanical linkage is not flexible or adaptable for the application of an adjustable joint. In the present invention the hydraulic hoses will flex with the movement of the boom extension 30 without any difficulty. A solid mechanical linkage is not so adaptable or flexible.

Thus there has been provided in accordance with the invention, an earth moving or grading machine that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An earth moving machine comprising:

a base structure, a first boom pivotally mounted on the base structure, a second boom telescopically mounted relative to the first boom, a third boom having its innermost end mounted to the outermost end of the second boom, articulated connecting means for operatively connecting the third boom to the second boom, the articulated connecting means comprising a pivot rod perpendicular to the long axis of the second and third booms, receiving holes in the outermost end of the second boom and the innermost end of the third boom, the pivot rod passing through the complementary aligned receiving holes, and a fixed length connecting link spaced apart from the rod, the fixed length link having opposite ends, one end fastened to the outermost end of the second boom and the other end fastened to the innermost end of the third boom, the fixed length link separating the outermost end of the second boom from the innermost end of the third boom where the fixed length link is fastened while the second and third boom remain connected by the pivot rod causing the articulation of the second and third booms with respect to each other, a bucket means mounted to the outermost end of the third boom and hydraulic cylinder means mounted to the third boom and connected to the bucket for controlling the bucket movement.

2. The machine of claim 1 wherein the fixed length link is removable and may be replaced by a link of a different length thereby varying the angle of articulation.

3. The machine of claim 1 wherein the articulated connecting means further comprises a second fixed length connecting link having one of its ends connected to one end of the fixed length connecting link and the other end to the innermost end of the third boom thereby varying the angle of articulation between the second and third booms depending upon the lengths of the connecting links.

* * * * *